US005430897A

United States Patent [19]

Lavender

[11] Patent Number: 5,430,897

[45] Date of Patent: Jul. 11, 1995

[54] TOILET SEAT LOWERING DEVICE

[76] Inventor: Wendell E. Lavender, 90 Lawrence Hill Rd., Stamford, Conn. 06903

[21] Appl. No.: 261,771

[22] Filed: Jun. 20, 1994

[51] Int. Cl.[6] ..... A47K 13/10

[52] U.S. Cl. ..... 4/246.1

[58] Field of Search ..... 4/408, 409, 246.1, 246.3, 4/250, 249

[56] References Cited

U.S. PATENT DOCUMENTS

| | | | |
|---|---|---|---|
| 3,579,664 | 5/1971 | Johnson | 4/250 |
| 4,491,989 | 1/1985 | McGrail | 4/250 X |
| 5,060,318 | 10/1991 | Jaskiewicz | 4/246.3 |
| 5,319,810 | 6/1994 | Metzger | 4/408 |

FOREIGN PATENT DOCUMENTS

| | | | |
|---|---|---|---|
| 0492690 | 12/1955 | Italy | 4/246.1 |

*Primary Examiner*—Charles E. Phillips
*Attorney, Agent, or Firm*—Gordon L. Hart

[57] ABSTRACT

A device for lowering a toilet seat when the toilet is flushed comprises a trip wire attached at one of its ends to the toilet flush crank arm outside the toilet tank and leading through guide means to a point near the edge of the toilet seat. The trip wire is guided by guide means along the front of the tank from the crank arm to a point near the toilet seat in its upright position where the guide means turns the other end of the wire from its path along the front of the tank towards the toilet seat. When the crank arm is pushed down to flush the toilet, the wire is pushed through the guide means and the other end of the wire pushes the toilet seat forward to an unstable position from which the seat drops to its seating position on the toilet bowl.

2 Claims, 2 Drawing Sheets

TOILET SEAT LOWERING DEVICE

FIELD OF THE INVENTION

The invention relates to improved devices for lowering a toilet seat and more particularly to such a device that is actuated by turning a toilet flush crank arm outside the flush tank.

BACKGROUND OF THE INVENTION

In most toilets a flush tank is mounted on top of the bowl behind the seat. A flush crank arm is attached outside the front or side wall of the tank to a shaft which extends into the tank through an opening in the tank wall. This shaft actuates the toilet flush mechanism inside the tank when the crank arm outside the tank is manually cranked downward through a small arc to turn the shaft.

A toilet seat which covers all or part of a toilet bowl rim is attached behind the rim of the bowl by a hinge at the rear of the seat. The seat can be raised and lowered on its hinge between a stable horizontal position, at which the seat rests on the rim of the bowl, and a stable upright position just beyond vertical, at which the seat leans back against the tank. Usually a seat cover is similarly hinged and can be similarly raised and lowered. As the seat is swung forward from its stable upright position, it passes the vertical plane of the hinge whence the seat can drop freely by its own weight to its stable horizontal position, at which it is used as a seat.

My invention is a mechanism for lowering the toilet seat by pushing the seat slightly forward from its stable upright position, just enough so that the seat can drop by its own weight as described. The force for pushing the seat forward derives from manual cranking of the flush crank arm. When the crank arm is pushed down to flush the toilet, the seat is pushed forward and drops to its horizontal position on the toilet bowl rim.

One advantage of my invention is that the entire mechanism is outside the tank. In U.S. Pat. No. 5,222,260, a push pin was actuated, through mechanical linkage by a hydraulic drive inside the tank, causing the push pin to push the seat forward from the stable upright position to a point where it could fall by its own weight. That required permanently elevating the tank lid for access of the linkage to the inside of the tank.

Another advantage of my invention is that it requires no change in the existing structure of the toilet. In U.S. Pat. No. 5,060,318 the seat was lowered by a spring-assisted hinge mechanism. A trip wire was connected at one of its ends to the flush handle on the tank and at its other end to a push bar in contact with a shaft member of the seat hinge. When the flush handle was turned, the trip wire pushed against a pusher bar on the shaft member causing the shaft member of the hinge to turn enough to move the seat forward to a point where the seat would drop. That mechanism required a special hinge and shaft mechanism not available on ordinary toilets.

BRIEF DESCRIPTION OF THE INVENTION

My invention comprises a flexible trip wire with means at one of its ends for attachment to the flush crank arm on the outside of a toilet tank, wire guide means attached to the outer wall of the tank for guiding the flexible trip wire from the crank arm along the front of the tank and for holding the other end of the trip wire at a position where the end of the wire can push the seat forward away from the tank. The trip wire is slidable in the wire guide means and extends from its one end attached to the flush crank arm to the other end near the edge of the seat at its upright position. When the flush crank arm is pushed down, one end of the trip wire is pushed down with the crank arm. The trip wire slides through the wire guide means and its other end pushes the seat forward enough for the seat to drop. When the crank arm is released it returns to its upper position and the trip wire returns with it. Some preferred embodiments of the invention will be described in more detail with reference to the drawings.

DETAILED DESCRIPTION OF THE INVENTION

Figure 1:
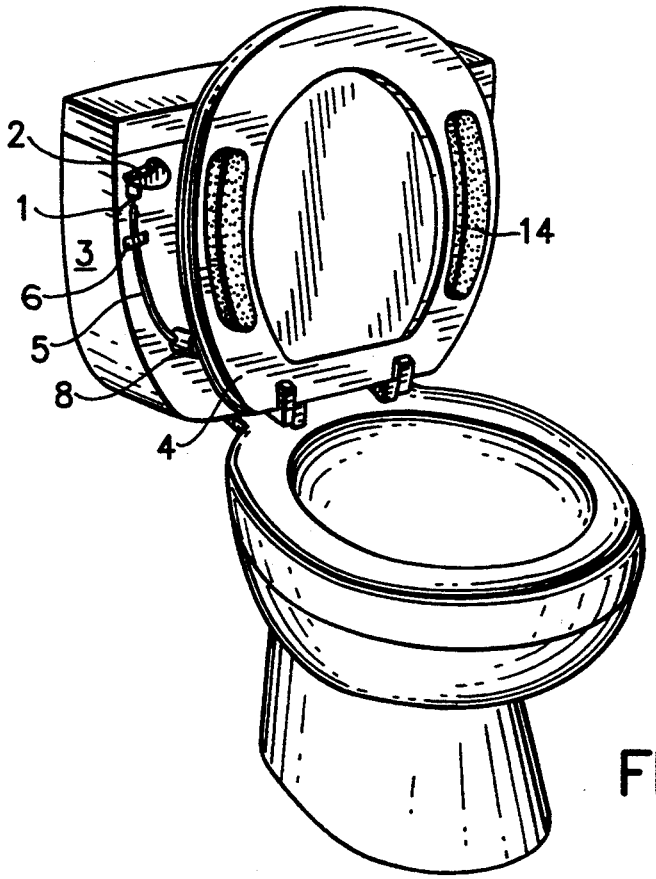
FIG. 1 is a perspective view illustrating a typical toilet with a device according to the invention attached for operation to lower the toilet seat when the toilet is flushed.

Referring now to FIG. 1, a trip wire 1 extends from one of its ends, which is attached to outer end of the crank arm 2 on the outside of a toilet tank 3, to its other end which is near an edge of the toilet seat 4 when the seat is in its upright stable position near the front of the toilet tank 3. Wire guide means comprises a guide tube 5 which extends from one of its ends just below the crank arm 2 to its other end near the edge of the toilet seat 4. The trip wire 1 extends for part of its length through the guide tube 5 but it extends outside the guide tube 5 at each of its ends. The guide tube 5 is fastened by at least one fastener 6 to the outside of the tank 3. A preferred position for a fastener 6 is near the end of the guide tube 5 that is nearer to the crank arm 2. The guide tube 5 may be held by the fastener 6 against the outer wall of the tank 3 or it may be held a small distance out from the wall by an extended fastener (not shown). The fastener 6 is attached firmly to the outer wall of the tank 3 by means of an adhesive or other attaching means and it holds the guide tube 5 firmly. A length of strong adhesive tape may be used as a fastener 6 to secure the guide tube 5 to the tank 3 at one or more points along the outside wall of the tank. In FIG. 1, the fastener 6 is a length of adhesive tape holding the guide tube 5 near its upper end firmly against the outer wall of the tank 3. The tape at its center passes over and adheres to the guide tube 5. Both ends of the tape adhere to the tank wall.

In another embodiment, the fastener may be a block (not shown) with adhesive on one side fastening the block to the tank wall and with means for fastening the block to the guide tube 5, such as a clamp attached to the outer end of the block for clamping the guide tube 5 to the block. The trip wire 1 must be flexible to follow curves in its path from the flush crank arm 2 to the point where it contacts the seat 4, and it must be stiff enough, with help of the wire guide means, to transmit the pushing force along its length without buckling. I prefer to use an automobile speedometer cable about one-eighth inch in diameter for a trip wire 1. Other flexible wires or cables of metal or plaastic or other material can be used.

Figure 2:
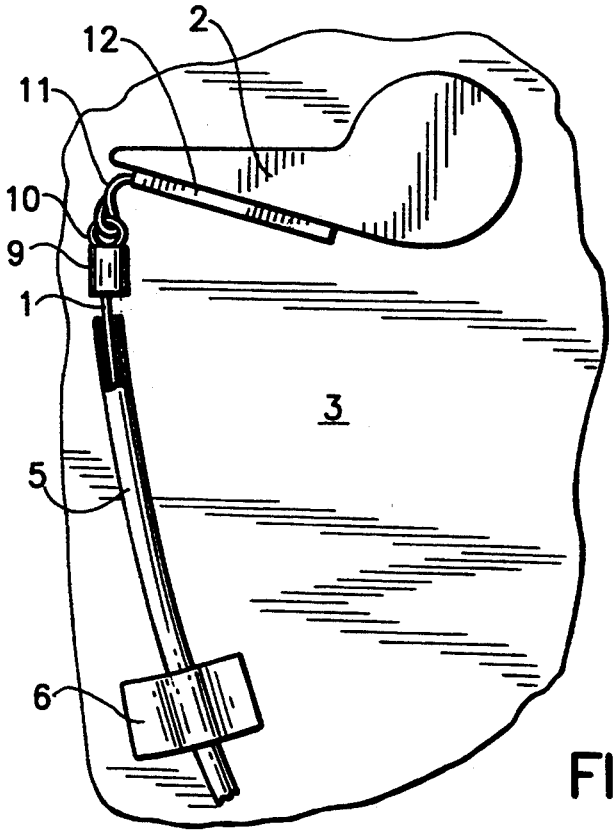
FIG. 2 is a detail view from FIG. 1 illustrating datail at the end of the trip wire which is attached to the toilet flush crank arm on the front of the tank.

As shown in FIG. 2, an end cap 9 having an attached hook 10 is fitted over one end of the trip wire 1 and is crimped in place to fasten the cap 9 to the end of the wire 1. The hook 10 on the end cap 9 is connected to a loop 11 fastened to the crank arm 2 with the hook 11 near or at the outer end of the arm 2. The loop may be fastened to the crank arm 2 by any suitable means. I have used a small slat 12 with a small wire loop 11 attached to one of its ends. The slat 12 is fixed to the under side of the crank arm 2 by any suitable means such as an adhesive or an elastic band holding the crank arm 2 and the slat 12 together. It is preferred to place the loop 11 at or near the outer end of the crank arm 2 so that, as the crank arm is pushed down, there will be sufficient linear travel of the trip wire 1 for its other end to push the seat 4 far enough forward to drop the seat.

Figure 3:
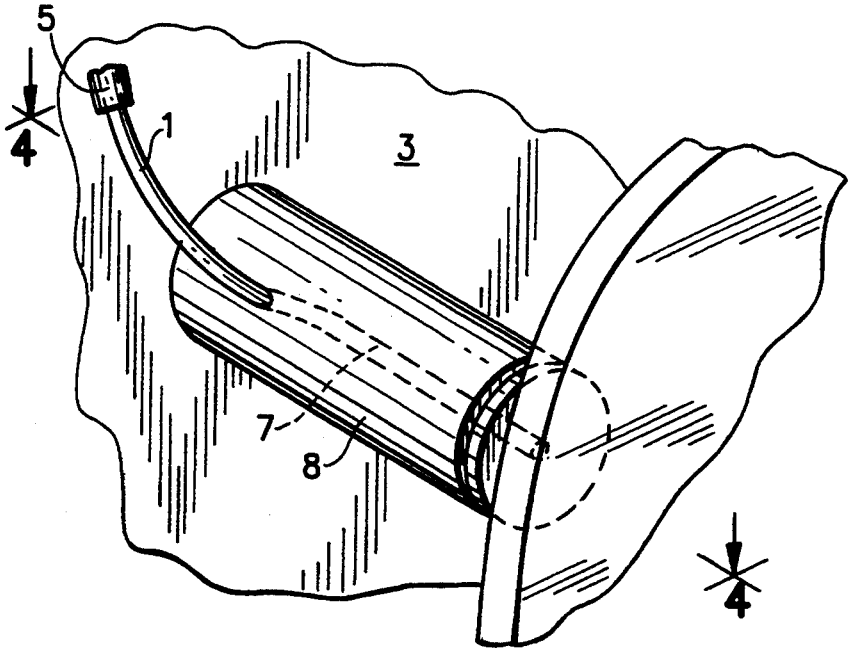
FIG. 3 is a detail view from FIG. 1 illustrating datail at the end of the trip wire which is is near the toilet seat.

FIG. 3 shows the other end of the guide tube 5, near the outer rim of the toilet seat 4. Here the trip wire 1 extends out of the end of the guide tube 5 and slides through a channel 7 in a guide block 8 which is attached to the outer wall of the tank 3. The channel 7 in the guide block 8 turns the trip wire to point the end of the trip wire 1 towards a point on the seat 4 where the end of the wire 1 will contact the seat 4 and push the seat forward. In the embodiment shown the channel 7 turns the flexible trip wire 1 from the line of its path along the front of the tank 3 to a line perpendicular to the top of the seat 4, so that the end of the wire 1 as it moves forward can push the seat forward. In preferred embodiments, the trip wire 1 has a push pad 13 on the wire end that pushes the seat 4 forward.

It is necessary to have some means for guiding the trip wire 1 along its path so that in response to the pushing force from the crank arm 2, the wire 1 will transmit the pushing force to its other end by linear movement. To do this, the wire 1 must be restrained from flexing or buckling along its length in response to the pushing force applied at one end. A preferred wire guide means comprises a tube 5 of diameter slightly larger than the wire diameter. Except at the two ends of the trip wire 1, the wire is contained inside the guide tube 5. The trip wire guide means must be fixed to the toilet tank 3 at a sufficient number of points to prevent buckling, in order to hold the wire on its path. When using a guide tube 5 in the preferred embodiment described, it is usually sufficient to fix the tube 5 to the tank wall at only one point, at or near the upper end of the tube 5 below the flush crank arm 2. The tube 5 extends along the front of the tank 3 to its other end near the guide block 8. Here the trip wire 1 extends out of the guide tube 5 and into a channel 7 in the guide block 8 which is attached to the tank 3. The guide block 8 is another part of the wire guide means. It holds the trip wire 1 in position and in turn the trip wire held by the guide block 8 holds the nearby end of the guide tube 5 in position. The guide block 8 guides the end of the wire towards the seat 4 that is to be pushed forward.

The trip wire 1 can slide freely through the guide tube 5 and a channel 7 in guide block 8, but together the tube 5 and guide block 8 will restrain the wire from unwanted lateral movements. A preferred guide block 8 is fastened to the front wall of the tank 3 and is positioned to point the end of the trip wire 1 towards a point on the outer edge of the seat 4 where the wire end will push the seat. The channel 7 inside the guide block 8 is curved to turn the trip wire 1 from the direction of its path along the wall of the tank 3 to a direction perpendicular to the wall of the tank. A toilet seat cover (not shown), which stands upright behind the upright seat 4 is not as wide as the seat 4, so the end of the trip wire 1 can clear the edge of the seat cover as the wire extends forward from the guide block 8 to contact the edge of the seat 4. The end of the trip wire 1 can then push the seat 4 forward enough for the seat to fall. I prefer to cover the end of the trip wire 1 with a push pad 13 of rubber or other material which can slip over the end of the wire. The push pad 13 will protect the seat from being scratched by the wire, and can provide traction to keep the wire end from slipping on the surface of the seat.

Figure 4:
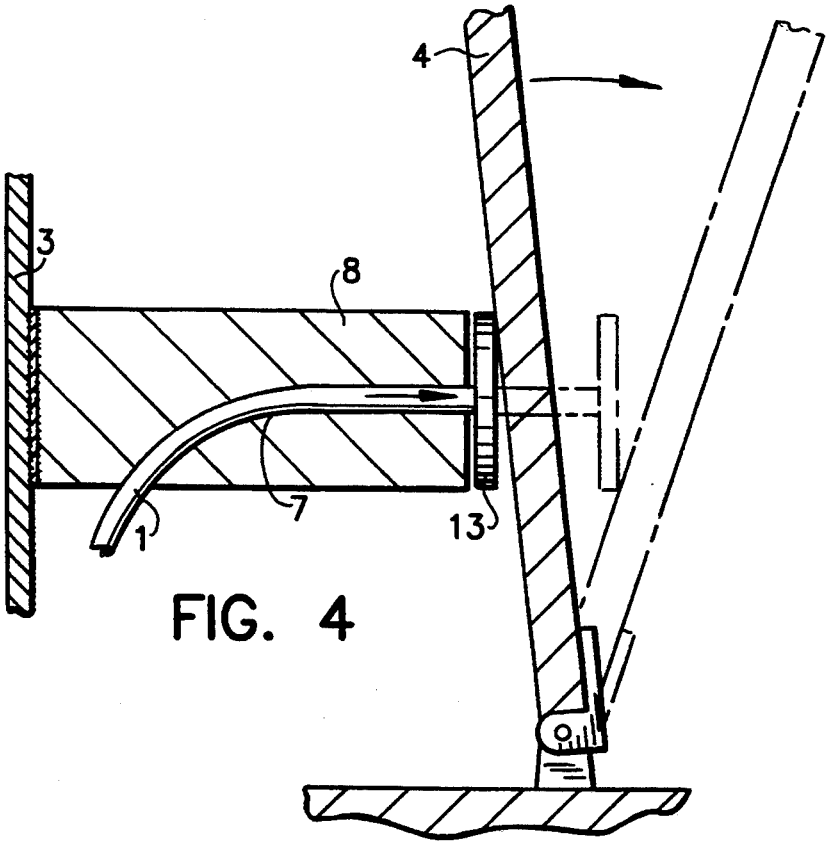
FIG. 4 is a side view in cross section along line 4—4 in FIG. 3 and includes a phantom view of the toilet seat tipped forward to the position where it can fall.

Referring now to FIG. 4, the guide block 8 is mounted at a position behind an edge of the seat 4 where the length of travel of the trip wire 1, when the flush crank arm 2 is pushed down, will be sufficient for the wire 1 to push the seat 4 forward to a fall position shown in phantom view in FIG. 4. A typical travel of the trip wire 1 at the end of the crank arm 2 is about one inch. The guide block 8 is fastened to the tank 3 opposite a point near the edge of the seat 4 that is near enough to the seat hinge so that the full travel of the trip wire 1, e.g. about one inch, will be enough for the end of the trip wire to push the seat 4 forward far enough to fall.

As the seat 4 swings freely to its seating position on the rim of the bowl it gains momentum so that it makes a noisy impact as the seat 4 strikes the rim. To quiet this noise, cushion pads 14 can be fastened at several points on the under side of the seat 4 to absorb the impact as the seat 4 strikes the rim. I prefer to use resilient cushion pads 14 made from plastic or rubber foam material, e.g. of the kind used in upholstery cushions, and those pads can be fastened to the seat by an adhesive.

I claim:

1. A device for lowering a toilet seat hinged at the back of a toilet bowl to swing freely between a lowered position for seating and an upright stable position leaning back against a toilet tank, said device comprising: a trip wire with means attached to one of its ends for connection of said one end of the wire to a flush crank arm on the outside of said toilet tank and means at its other end for pushing against the surface of the upright toilet seat to move the toilet seat forward until the seat falls; wire guide means for guiding the trip wire slidably through said wire guide means on a path from said crank arm along the front of said tank to a point near the toilet seat in its upright stable position and for turning the other end of the trip wire at said point from said path to direct said other end of the trip wire towards the surface of said toilet seat, said wire guide means comprising means for attaching the wire guide means to the outside of the toilet tank at one point near the crank arm and at another point near the toilet seat in its upright position.

2. A device defined by claim 1 wherein the wire guide means comprises:

a tube for guiding the trip wire through the tube along a path from the flush crank arm along the front of the toilet tank and means for attaching the tube near one of its ends to the toilet tank at a point near the flush crank arm, and a guide block and means for attaching the guide block to the toilet tank near the toilet seat in its upright position, said guide block comprising a channel through the guide block, through which the trip wire can slide turning its path from the direction of its path along the front of the tank at the entry to said channel to a direction towards the surface of said toilet seat at the exit from said channel.

* * * * *